US006736299B2

(12) United States Patent
Bergkvist

(10) Patent No.: US 6,736,299 B2
(45) Date of Patent: May 18, 2004

(54) BABY CARRYING HARNESS

(75) Inventor: Håkan Bergkvist, Bromma (SE)

(73) Assignee: Baby Bjorn AB, Danderyd (SE)

( * ) Notice: Subject to any disclaimer, the term of this patent is extended or adjusted under 35 U.S.C. 154(b) by 0 days.

(21) Appl. No.: 10/257,410

(22) PCT Filed: Apr. 26, 2001

(86) PCT No.: PCT/SE01/00898

§ 371 (c)(1),
(2), (4) Date: Oct. 21, 2002

(87) PCT Pub. No.: WO01/84984

PCT Pub. Date: Nov. 15, 2001

(65) Prior Publication Data

US 2003/0047573 A1 Mar. 13, 2003

(30) Foreign Application Priority Data

May 8, 2000 (SE) ..... 0001700-4

(51) Int. Cl.[7] ..... A61G 1/00
(52) U.S. Cl. ..... 224/160
(58) Field of Search ..... 224/158, 159, 224/160

(56) References Cited

U.S. PATENT DOCUMENTS 3,197,100 A * 7/1965 Thompson ..... 224/160
3,871,562 A * 3/1975 Grenier ..... 224/160
4,149,687 A * 4/1979 Nunemacher ..... 224/159
4,402,440 A * 9/1983 Purtzer et al. ..... 224/160
4,467,945 A * 8/1984 Schaapveld ..... 224/160
4,487,346 A * 12/1984 Fischer, Jr. ..... 224/160
5,205,451 A * 4/1993 Manzer ..... 224/161
5,246,152 A * 9/1993 Dotseth ..... 224/159
5,490,620 A * 2/1996 Bergqvist ..... 224/160
5,690,258 A * 11/1997 Kataoka ..... 224/160
5,732,861 A * 3/1998 Jakobson ..... 224/160

FOREIGN PATENT DOCUMENTS

SE 500 164 5/1994
SE 510 036 4/1999

* cited by examiner

*Primary Examiner*—Stephen K. Cronin
(74) *Attorney, Agent, or Firm*—Jacobson Holman PLLC

(57) ABSTRACT

A baby-carrying harness has fitted thereto a baby carrying pouch which includes a front wall that has at least one free side edge (24) which can be fastened to an adjacent harness chest strap (31) by means of a connecting device (41, 32) for supporting the front wall (22) of the carrier pouch on the harness (1) and define a baby leg opening between the front wall (22) and the chest strap (31) beneath the connecting device. The connecting device includes a hook fastening (75, 43; 32, 33) which has a downwardly extending finger (43) that engages a male part (75, 43) fitted on the front wall (22), and a finger-receiving female part (32, 33) carried by the harness (1, 31), wherein the upper part of the male part is connected to the front wall. The upper portion of the male part is joined to the front wall (22) in the proximity of the finger, at least in the region of the free end of said finger. The finger (43) and the female part (32, 33) have a mutual engagement length (A) of at least 4 cm, preferably about 7 cm, for holding the side edge (24) of the front wall (22) against the harness (1, 31) along a corresponding distance, so as to limit the size of the leg opening.

12 Claims, 3 Drawing Sheets

BABY CARRYING HARNESS

This is a nationalization of PCT/SE01/00898, filed Apr. 26, 2001 and published in English.

The present invention relates to a baby carrying harness of the kind defined in the preamble of claim 1.

The baby carrying harness is thus a typically known harness to which a baby carrying pouch is attached. The lower part of the pouch is connected to the harness and the pouch has a front wall which includes at least one free side edge. The upper part of the free side edge can be respectively released from and fastened to the harness respectively through the medium of a connecting device that functions to support the front wall from the harness and to define between the free side edge of the front wall and the harness beneath the connecting device an opening for receiving the legs of a baby and located. The connecting device includes a hook fastener which comprises a male part that has a downwardly pointing finger on the front wall, and a closely situated finger-receiving female part carried by the harness.

One problem with a harness of this description is that the opening that accommodates the baby's legs is defined by the side edge of the front wall and the adjacent part of the harness strap, along a distance from the connection point between the hook fastener and the bottom connection of the front wall to the harness.

The connection between the male part of the hook fastener and the front piece defines the upper baby support level of lie front wall, where a baby is carried by the harness. However, when this level is sufficiently high, there is a risk that the leg opening will be so large as to allow both legs of a small baby to pass through one leg opening and the baby falling therethrough.

It is therefore desirable to be able to reduce the size of the leg opening while keeping the advantage of being able to use readily a hook fastener that can be established quickly and securely with a single, easily effected coupling operation.

One object of the present invention is to provide a baby carrying harness with which safe connection of the front wall to the harness is achieved with the aid of a coupling device in the form of a hook fastener, and, in conjunction with establishing said collection, will also achieve mutual connection of the side edge of the front wall with the harness along a substantial part of the side edge of said front wall such as to limit the size of the leg opening.

This object is achieved by the invention.

The invention is defined in the accompanying independent claim 1.

Further embodiments of the invention will be apparent from the accompanying dependent Claims.

In preferred embodiments of the invention, the finger of the hook fastening has an effective length of at least 2 cm, and preferably at least 3 or 4 cm. Finger lengths of least 5 cm or 6 cm have been considered in connection with the development of the invention, and in the case of an embodiment at present preferred the finger has a length of 8.5 cm.

The female part may include a pocket which is orientated vertically in a harness strap that extends generally vertically and adjacent to the free side-edge of the pocket. The entrance to the pocket may be formed by a ring-shaped fitting, for instance a plastic fitting, that is fastened, e.g., sewn, to the harness strap in the close proximity to the pocket entrance. The ring-shaped fitting therewith provides a stable and strong support for the finger at its root. The pocket extends vertically to receive the finger along essentially its full length, whereby the harness and the front wall are held together along the length of the finger up to the tip of the finger. This enables the size of the leg opening to be restricted, while ensuring that the finger cannot easily be lifted up out of the pocket/the female part owing to the length of the finger. Insertion of the finger into the pocket is a clear-cut operation and the finger will remain in the pocket even should the front wall and the male part of the hook fastener be lifted upwards, as might well happen should the wearer sit down on a chair and therewith cause the pouch and the baby to be moved upwards as they come into contact with the user's knee (the front side of the thighs in the proximity of the knees).

Because the finger has a substantial length, the user is able to detect when the finger does not extend into the pocket correctly, for instance should the tip of the finger fasten in the entrance to the pocket.

In one further embodiment of the invention, the finger is supported by a body that carries a latch mechanism which functions to automatically latch the finger to the female part wherein the finger has been inserted fully into said pocket. The latch mechanism includes a spring-biased element, or bolt, which engages with a latch hook in the ring-shaped fitting and which can be bent or deflected to one side so as to pass free from the latch hook of the fitting and therewith enable the finger to be withdrawn therefrom, said latch hook being moved aside by the force exerted by a finger of the user.

The aforesaid male part is preferably provided with a generally U-shaped metallic strengthening element whose one leg extends through a finger of the hook fastener and whose other leg extends along said body, so that the hook fastening function will be maintained even should the finger break-off. The provision of the U-shaped strengthening element minimises the risks that would occur should the body and the finger be made of a plastic material that becomes brittle with the passage of time and exposure to sunlight, etc. The body will preferably include a tongue that facilitates sewing of the body to the front wall of the pouch. The tongue may have the form of a latticework, which is integral with said body.

The finger will preferably have along its length an outwardly projecting spring-strip which is cut obliquely in the proximity of the free end of the finger, so as to form an undercut together with the finger. The finger strip is located close to said body. This undercut prevents erroneous threading of the finger, for instance on a harness strap. The spring strip imparts to the finger a particular cross-sectional contour which coincides essentially with the entrance opening of the fitting, so as to obtain a coding function, i.e. the finger must have a cross-sectional shape that will be accommodated in the opening in order to be able to be received in the female part.

One advantage afforded by the invention is that the coupling device provides, in conjunction with a coupling operation, a positive coupling between the harness and the upper part of the free side-edge of the front wall, and also provides a long vertical coupling distance between the finger and its receiving pocket, so that the leg opening will have an appropriately small size.

If it is found necessary to reduce the size of the leg opening still further, it is, of course, possible to achieve this with the aid of a further connection. This further collection may consist of a pull-on strap or looped strap, whose one end is fastened to the harness and the other end of which has a buttonhole that can be fastened to a button on the side-edge of the front wall in a position beneath the tip of the finger.

The fitting on the female part may be established at a height level such that the flexible front wall will provide an effective horizontal support line in relation to the baby, at a safe level.

The invention will now be described by way of example and with reference to the accompanying drawings.

Figure 1:
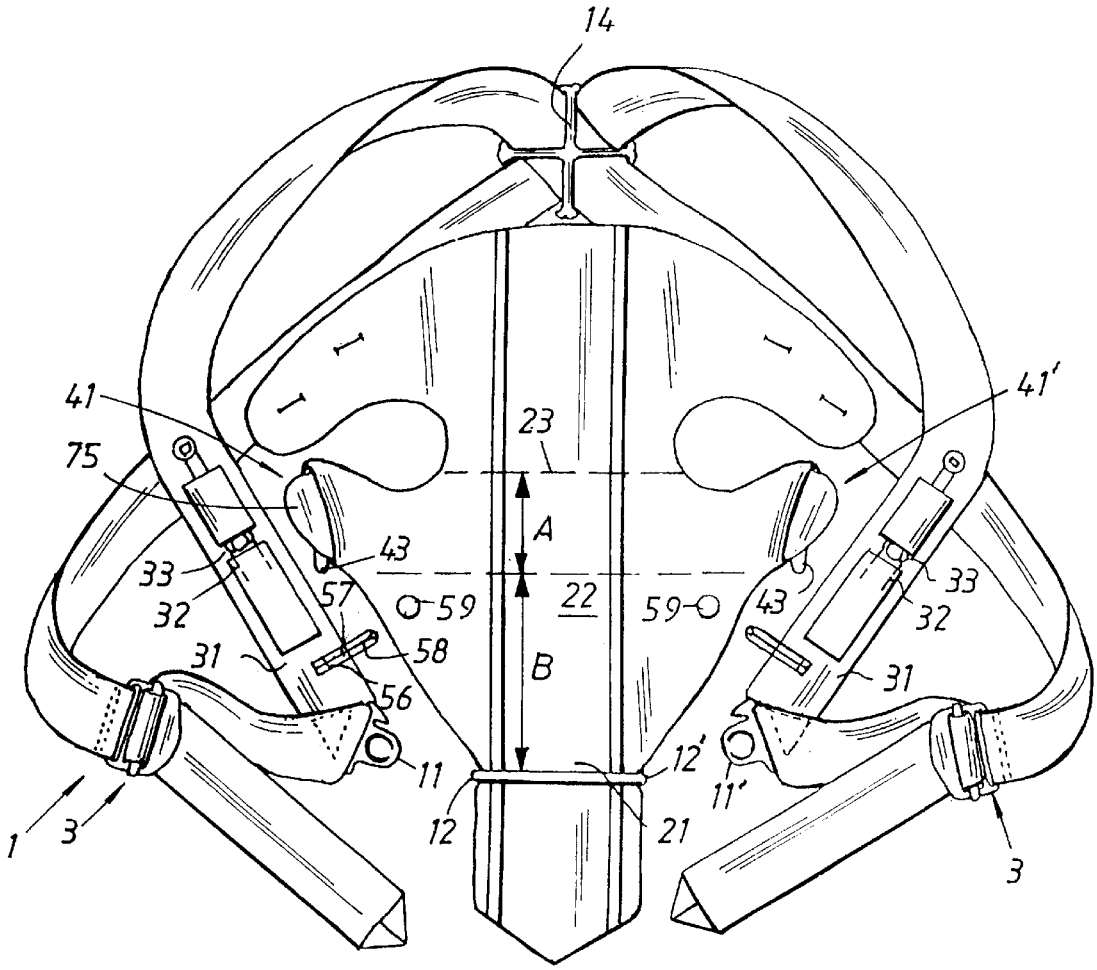
FIG. 1 is an overview of an inventive baby carrying harness.

FIG. 1 illustrates schematically a harness 1 having a baby carrying pouch 2. The harness 1 comprises a waist belt that is connected to the coupling part 12 on the lower part 21 of a flexible front piece 22 of the pocket 2, by means of releasable couplings 11.

The harness 1 also includes two vertically orientated chest straps 31 which extend vertically on the front side of the user and connect to the waist strap in the proximity of respective couplings 11. The straps 31 are coupled to the waist strap on the user's back. In the case of one embodiment, the harness 1 is, in principle, formed by a closed loop which is held together on the rear side of the harness by a fitting 14 so as to form two eyelets which each carry a respective coupling-part 11 for connection to the lower part of the pouch. The upper part of the chest straps 31 includes on the front side of the carrier an upwardly open and vertically elongate pocket 32, the pocket entrance being formed by a generally ring-shaped fitting 33 sewn securely to the strap 31. Shown on the free side-edge of the upper part of the front piece 22 is a fitting-part 41 which is sewn firmly to the front wall 22, with a latticework 42. The part 41 includes a body 75 and a finger 43 which is attached to the upper portion of the rear side of the body 75 and which extends generally vertically downwards for receipt in the pocket 32 on the nearby strap 31, via the fitting 33.

There is shown on the opposing edge of the front wall 22 a fitting-part 41 intended for engagement with a corresponding pocket 32 in its nearby strap 31. The fittings 41, 41' may be mutually identical but in mirror image relative to each other.

The waist strap of the harness is shown to have a fitting 3 which enables the size of the waist strap to be shortened by pulling the ends of the straps obliquely downwards and forwards.

The illustrated fitting 11' can be replaced with a fixed connection and the fitting-part 41' may be replaced with a fixed connection between the upper part of the front wall 22 and the nearby front strap 31. A leg opening, whose largest dimension is indicated at B, is established between respective straps 31 and the free side-edge of the front wall 22 in the region between the coupling 11 and the hook fastening 41, 32. The body 75, the finger 43 and the pocket 32 function to hold the side-edge and the strap 31 close together above the upper end of the leg opening, along a distance A that extends to a level that can be considered to collect with the root of the finger 43 in respective fittings 41, 41'. The broken line 23 defines an upper support limit for the flexible front wall 22 in relation to a baby seated in the carrier pouch or pocket. It will be seen that the body/base element 75 is connected to the front piece 22 on at least its upper part (the level 23 in FIG. 1) and in a position of close proximity with the bottom free end of the finger 43, immediately above the lower end of the finger, so as to define a gap between the finger and the body along the finger up to the point of connection between the finger and the body. This gap is conveniently relatively narrow in the vicinity of the bottom end of the finger.

The harness 31 and the side-edge of the front piece are therewith held together from the pocket 32 right down to the region of the free end of the finger, so that the size of the leg opening will be reduced to a corresponding extent when the finger 43 is fully inserted into the pocket. Insertion of the finger into the pocket is facilitated by allowing the lower end-part of the finger to project freely down beyond the bottom end of the body.

Figure 3:
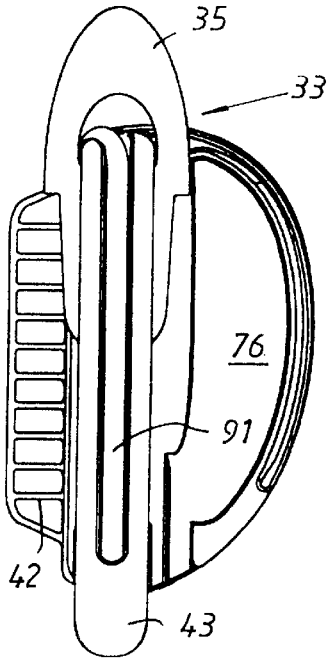
FIG. 3 is a rear view of the hook fastening.
Figure 2:
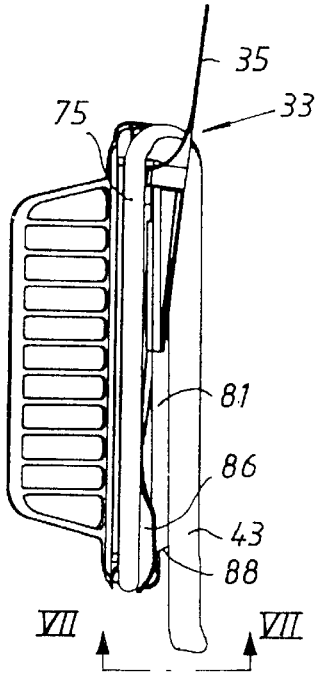
FIG. 2 is a side view of an inventive hook fastening.
Figure 4:
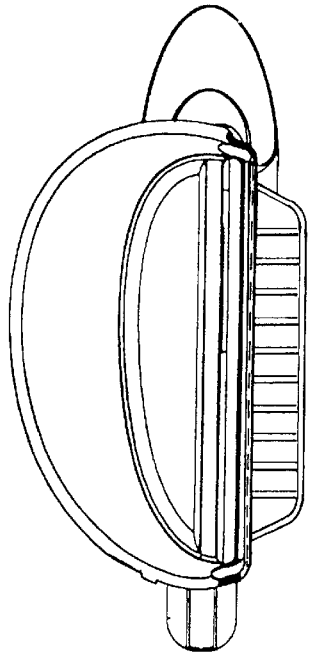
FIG. 4 is a front view of the hook fastening, in a depiction corresponding to that of the fitting part shown in FIG. 1.

FIGS. 2, 3 and 4 are respectively a side view, rear view and front view of the fitting-part 41 as applied to the fitting 33.

Figure 5:
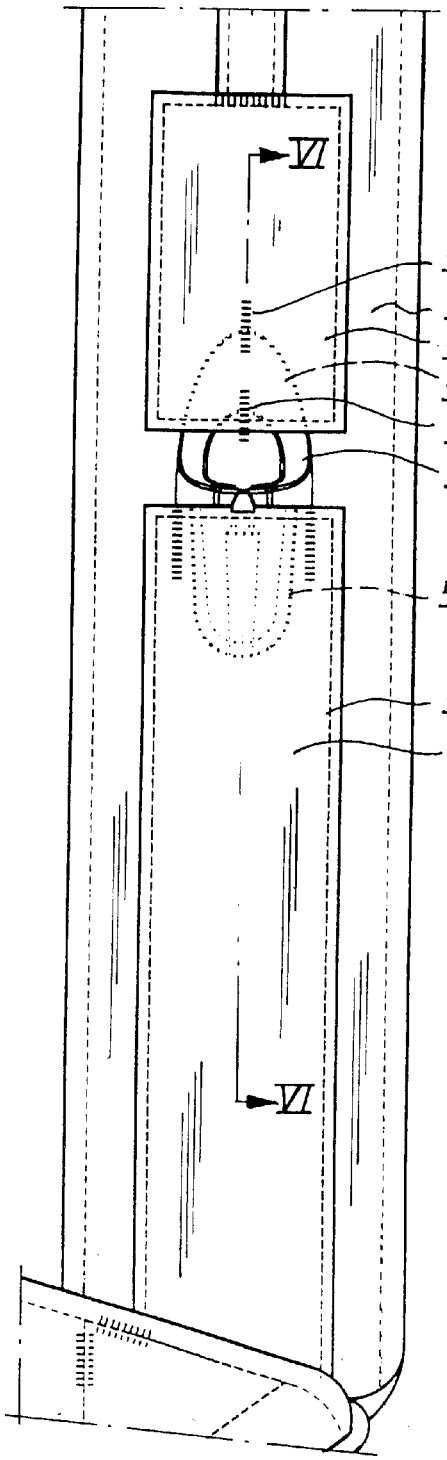
FIG. 5 is a plan view of the female part of the hook fastening.
Figure 6:
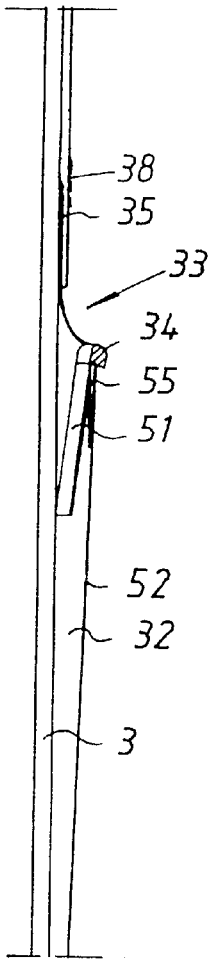
FIG. 6 is a schematic sectional view taken on the line VI—VI in FIG. 5.

As will be seen from FIG. 5, the fitting 33 has an entrance ring 34 that includes an upper thin lip 35 placed between the actual strap 31 and a reinforcing covering strip 36 and sewn securely therebetween by means of short seams 38, 39. The fitting 33 has beneath the entrance ring 34 a guide channel 51 for the finger 43. It will be seen that the strap 31 and the lower part of the fitting 33 are covered by a strip of reinforcing fabric 52 which is sewn along its longitudinal edges to form the pocket 32.

Figure 10:
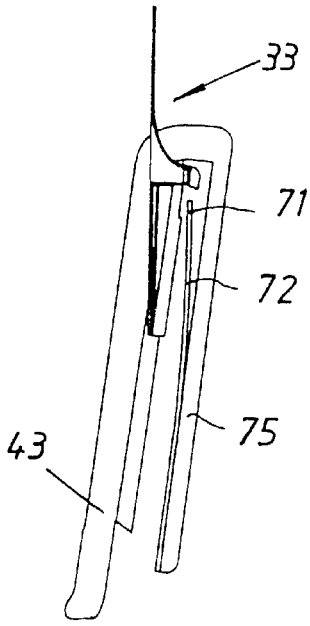
FIG. 10 illustrates schematically and in side view the latch arrangement included in the hook fastening.

The upper part of the guide channel 51 has a recess immediately beneath the ring 34 such as to form an effective latch hook for the end 71 of a latch tongue 42 connected to the bottom end-part of a body 75 that forms the outwardly facing side of the fitting-part 40. The latch tongue 72 is spring-biased in an outward direction and extends generally upwards so that the end 71 will grip beneath the ring 34 of the fitting 33 (see FIG. 10).

Figure 7:
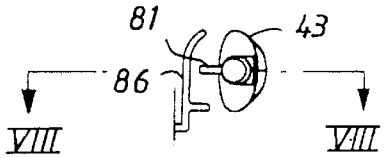
FIG. 7 is an end view taken on the line VII—VII in FIG. 2.

As will be seen from FIG. 7, the side of the finger 43 facing towards the body 75 has a spring or a strip 81 that extends along the major part of the length of the finger 43. The finger 43 and its strip 81 therewith has a generally T-shaped configuration. FIG. 7 also shows that the body 75 has on its inner surface a generally cup-shaped cover element 86 that extends along the strip 81. The strip 81 is terminated short of the free end of the finger 43 and has an undercut 88 which functions to prevent wrong application of the fitting-part 41, for instance on the strap 31.

Figure 9:
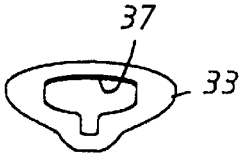
FIG. 9 is a view of the admission means or entrance of the female part.
Figure 8:
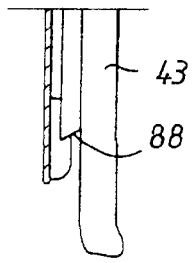
FIG. 8 is a sectional view taken on the line VIII—VIII in FIG. 7.

As shown in FIG. 9, the cross-sectional configuration of the entrance opening 37 of the fitting 33 corresponds to the cross-sectional configuration of the finger 43 together with the strip 81, so as to provide a coding function. FIG. 8 shows the oblique, bevel undercut 88 on the strip 81 more clearly.

The guide channel 51 in the fitting 32 has an opening 55 which enables the free end-part 71 of the supporting tongue 72 to take an outer latching position. The end 71 may be bevelled, and the ring 34 may be correspondingly bevelled to prevent the tongue 72 from unintentionally slipping past its latching engagement with the ring 34.

FIG. 3 shows a grip flap 76 which projects laterally out from the latching tongue 72. The flap 76 and the body 42 can be squeezed together with one hand, so as to move the latching tongue 72 out of engagement with the ring 34, therewith enabling the fitting-part 41 to be lifted out of the pocket 32 and the fitting 33. It will be realised that the spring-biased latching tongue 72 will snap into its latching position automatically, after having fully inserted the finger 43 into the ring 34.

Also shown in FIG. 3 is a leg 91 of a generally U-shaped metallic element, the other leg of which is anchored in the body 75. The U-shaped element provides a spring function for the finger 43, on the one hand, and, on the other hand, may also replace the finger 43 when the finger is comprised of a plastic material that has become brittle or has been subjected to excess loads.

FIGS. 2–4 also show that the body 75 includes a latticework 42, which functions to facilitate anchorage of the fitting-part 41, by placing the latticework 42 between two fabric layers on the front wall 22, these layers then being sewn with a seam that passes through the latticework 42.

As shown in FIG. 1, one end of a tape 57 is sewn to the strap 31 at 56 and the other end of the tape includes a buttonhole 58 which enables the tape to be detachably coupled to a button 59 on the front piece 22, therewith enabling the effective size of the leg opening to be further restricted. In extreme cases, the tape 57 can be used when the authorities require a size of leg opening that would be uncomfortable to achieve with a finger 43 of the then required length.

It will also be seen from FIG. 1 that the baby carrying pouch 2 can be released from at least one side of the harness, by opening the coupling 11, the belt coupling 57 and the hook fastening 41, 32, so as to enable the baby carrying harness to be removed and donned as a jacket in general terms. In the case of preferred embodiments, both sides of the baby carrying pouch are connected detachably to the harness 1, so as to allow a user to place the baby in the harness or remove the baby therefrom on either the right side or the left side of said harness. The female part and the male part of respective hook fastenings will preferably be coloured to mark their mutual relationship.

What is claimed is:

1. A baby carrying harness that has mounted thereon a baby carrying pouch which includes a front wall (22) that has at least one free side edge (24) which can be fastened to an adjacent chest strap (31) on said harness (1) by means of a connecting device (32, 33, 43, 75; 56–59) for supporting the front wall (22) on the harness (1) and for defining a baby leg opening between the front wall (22) and the chest strap (31) beneath said connecting device, wherein the connecting device includes a hook fastening (75, 43; 32, 33) that includes a male part (75, 43) which is fitted on the front wall (22) and comprises a downwardly extending finger (43), and a finger-receiving female part (32, 33) carried by the harness (1, 31), wherein the upper portion of the male part is connected to the front wall, and wherein the harness is characterised in that the male part includes a base element (75) that is connected to the front wall (22) in the proximity of the finger, at least in the region of the free end of said finger; and in that the finger (43) and the female part (32, 33) have a mutual engagement length (A) of at least 4 cm, for holding the front wall (22) against the harness (1, 31) along a corresponding distance.

2. A baby carrying harness according to claim 1, characterised in that the male part is provided on one side with a latticework tongue (42) that enables the male part to be sewn to the front piece (22).

3. A baby carrying harness according to claim 1, characterised in that the finger (43) and the female part (32, 33) have a mutual engagement length of at least 6 cm.

4. A baby carrying harness according to claim 1, characterised by a separate connecting device (56–59) for connecting the chest strap (31) and the adjacent side edge (24) of the front wall (22) between the hook fastening (41, 42) and the connection of the harness (1) to the lower part of the baby carrying pouch (2) in a separate operation, such as to establish a leg opening of selected size.

5. A baby carrying harness according to claim 1, characterised in that the male part and the female part belonging to a hook fastening are colour-coded to indicate their mutual relationship.

6. A baby carrying harness according to claim 1, characterised in that the finger (43) and the female part (32, 33) have a mutual engagement length of about 8.5 cm.

7. A baby carrying harness according to claim 1, characterised in that the male part includes a front plate (75); in that the finger is placed against the upper end-part of the plate (75); in that the side of the finger (43) facing towards the plate (75) has an elongate strip (81) which extends along the finger and terminates short of the free end of said finger (43); in that the end of the strip is cut obliquely so as to define an acute angle with the adjacent free end-part of the finger; and in that the outer end of the strip (81) lies adjacent a part of the plate (75).

8. A baby carrying harness according to claim 7, characterised in that the female part includes an elongate finger-receiving pocket (32) established in a harness strap (31), wherein the entrance to said pocket is formed by a ring-shaped fitting (33) whose inner contour or cross-sectional contour (37) corresponds to the cross-sectional contour of the finger (41) and the strip (81).

9. A baby carrying harness according to claim 8, characterised in that the ring-shaped has an abutment for co-action with a springy latching tongue (72) on the male part; and in that said ring (33) is sewn firmly in the harness (1, 31).

10. A baby carrying harness according to claim 1, characterised in that the hook fastening includes a latch arrangement (71, 72, 34) which functions to automatically latch the finger (43) withdrawably to the female part in the fully assembled state of the hook fastening; and in that the latch arrangement can be actuated manually to enable the finger (43) to be withdrawn from the female part (32, 33).

11. A baby carrying harness according to claim 10, characterised in that the manually actuable part (71, 72) of the latch arrangement is carried by the male part; and in that the female part (32, 33) has a latch hook (55, 34).

12. A baby carrying harness according to claim 10, characterised in that the base element has the form of a plate which extends laterally from the front wall so as to enable the plate to be comfortably grasped with the hand of the nearby arm of the user, wherewith the carrier arrangement is such that it can be actuated by the fingers of the hand gripping said base element for lifting or lowering the same.

* * * * *